US005483792A

United States Patent [19]

Czachor et al.

[11] Patent Number: 5,483,792

[45] Date of Patent: Jan. 16, 1996

[54] TURBINE FRAME STIFFENING RAILS

[75] Inventors: Robert P. Czachor, Cincinnati; Michael L. Barron, Loveland, both of Ohio

[73] Assignee: General Electric Company, Cincinnati, Ohio

[21] Appl. No.: 284,702

[22] Filed: Aug. 2, 1994

Related U.S. Application Data

[63] Continuation of Ser. No. 58,613, May 5, 1993, abandoned.

[51] Int. Cl.[6] ..... F02C 7/20

[52] U.S. Cl. ..... 60/39.31; 60/39.75

[58] Field of Search ..... 60/39.31, 39.75; 415/142, 189, 209.3, 209.4

[56] References Cited

U.S. PATENT DOCUMENTS

| | | |
|---|---|---|
| 2,616,662 | 11/1952 | Mierley . |
| 2,724,544 | 11/1955 | Hardigg . |
| 3,024,969 | 3/1962 | Russell . |
| 3,166,903 | 1/1965 | White . |
| 3,303,998 | 2/1967 | Koff et al. . |
| 3,313,105 | 4/1967 | Johnson . |
| 3,403,889 | 10/1968 | Ciokajlo . |
| 3,708,242 | 1/1973 | Bruneau et al. . |
| 4,492,078 | 2/1985 | Williamson . |
| 4,987,736 | 1/1991 | Ciokajlo et al. . |
| 5,076,049 | 12/1991 | Von Benken et al. . |
| 5,180,282 | 1/1993 | Lenhart et al. . |

OTHER PUBLICATIONS

GEK 9894, Page from GE Parts Manual for LM6000 Engine pp. 2–178, published Dec. 1, 1992.

*Primary Examiner*—Richard A. Bertsch
*Assistant Examiner*—William Wicker
*Attorney, Agent, or Firm*—Andrew C. Hess; Patrick R. Scanlon

[57] ABSTRACT

A turbine frame includes outer and inner coaxially disposed annular casings having a plurality of circumferentially spaced apart struts extending therebetween is provided with at least one and preferably two axially spaced apart polygonal stiffening rails, a forward rail and an aft rail, circumferentially disposed on the outer annular casing. The rails have at least a first section with a constant cross-sectional area normal to the casing in a circumferential direction around the outer casing, a linear centroid distribution of the cross-sections in the circumferential direction, and the centroids lie in a first plane P1 which is parallel to and spaced apart from a second plane P2 that is tangential to the outer casing mid-way between adjacent struts.

24 Claims, 5 Drawing Sheets

TURBINE FRAME STIFFENING RAILS

This application is a continuation of application Ser. No. 08/058,613, filed May 5, 1993, now abandoned.

CROSS REFERENCE TO RELATED APPLICATION

The present invention is related to patent application Ser. No. 07/988,637, entitled "Turbine Frame" by Robert P. Czachor et al. filed Dec. 10, 1992, now U.S. Pat. No. 5,292,227.

FIELD OF THE INVENTION

The present invention relates generally to gas turbine engine turbine frames for supporting bearings and shafts, and, more specifically, to stiffening rails around the turbine frame casing.

BACKGROUND OF THE INVENTION

Description of Related Art

Gas turbine engines include one or more rotor shafts supported by bearings which, in turn, are supported by annular frames. The frame includes an annular casing spaced radially outwardly from an annular hub, with a plurality of circumferentially spaced apart struts extending therebetween. The struts may be integrally formed with the casing and hub in a common casting, for example, or may be suitably bolted thereto. In either configuration, the overall frame must have suitable structural rigidity for supporting the rotor shaft to minimize deflections thereof during operation.

These structural engine frames are usually required to transmit loads from the internal rotor bearing support, typically the hub, across the engine flowpath, by means of the equi-spaced struts, to a flange mounted on the case. In order to minimize rotor blade tip clearances and maximize engine performance, deflections of the rotor relative to the static structure must be minimized which may be accomplished by incorporating a sufficiently stiff frame. Frame stiffness is also a very significant factor for controlling rotor dynamics. A stiff support for the rotor will raise rotor natural frequencies above the operating range of the engine, thus preventing undesirable levels of resonances in the engine operating range.

Because the bearing load is transferred into the case at local points, namely the strut ends, the design of the case is important to the overall frame stiffness. Bending can occur in relatively thin annular case sections due to these point loads thereby introducing unwanted flexibility in the engine frame design. However, in order to minimize engine weight and improve aircraft fuel efficiency and cost, it is desirable to maintain the exterior casing at a minimum thickness to the extent that little bending stiffness is offered by the casing itself.

One example of the prior art solution to this problem is shown in U.S. Pat. No. 5,076,049, entitled "Pretensioned Frame" and provides a polygonal exterior casing. The strut end loads are transmitted through the case in direct tension and the case, while still relatively thin, is loaded in tension, rather than bending, and frame is significantly stiffer than previous turbine frame designs. One drawback of this design is that the polygonal case is subject to very high bending stresses because the internal pressure is high during operation and the pressure differential across the case is great. Internal pressure attempts to bend the polygonal panels back to a circular shape and therefore is not suitable in high pressure applications, such as a high pressure turbine exit frame.

Another example of a prior art solution to this problem is shown in U.S. Pat. No. 3,403,889, entitled "Frame Assembly Having Low Thermal Stress" and provides circular rings fabricated on the case. A similar type of design is used on turbine mid-frame of the General Electric CF6-50 aircraft gas turbine engine as shown and disclosed on pages 495–498 and FIG. 25–35 of "Aircraft Gas Turbine Technology, Second Edition" by Irwin E. Treager. These design adds significant I-section ring support to the case thereby counteracting the bending caused by the strut end loads. The increased stiffness afforded by the ring reinforced case improves frame overall stiffness but is still structurally inefficient, in the sense that transmission of loads through bending requires more material for a given stiffness than would be required to transmit loads in direct tension. An advantage of this design is that it can accommodate significant internal pressure, since the casing skin is circular. A disadvantage of this design is that the circumferentially continuous radial height of these rings produces undesirable high thermal stress levels because of the large temperature differentials across the outer casing. These rings are radially constrained and the higher the ring the greater the stress as well as the greater the reinforcing effect on the case by the rings which makes the frame stiffer.

Polygonal stiffening rings have been used on the turbine frame of the General Electric LM6000 marine gas turbine engine. The rings have a polygonal radially outer surface or perimeter and a constant axial thickness. It does not provide a direct tension load path but rather a circumferentially curved load path and is subject to the thermal stress problems as discussed earlier. The structural inefficiency of this prior art design results from the fact that the centroids of the polygonal ring cross-sections do not subtend a straight line from strut-end to strut end. In addition, the cross-sectional area of these same sections is not constant. The result of this is bending in the polygonal stiffening rings and a non-optimum stress distribution An "ideal" design is a "rope", i.e., a member with a constant cross-section & forming a straight line between load points, carrying tension stress only but as with many ideal designs the realities of the harsh engine environment and other design considerations prevent the use of such a "rope" stiffener for the frame to provide a circumferentially linear load path between struts.

A significant drawback of the prior art designs, particularly as applied to hot section applications, is the severe thermal gradient which will develop between the hot case, exposed to engine cycle air on the inner diameter (ID), and relatively cool stiffener rings, exposed to under-cowl air in operation. These gradients cause thermal stresses, as discussed earlier, that lead to cracking of such cases, and sometimes require active heating of the reinforcing rings to prevent such distress. Heating takes away power from the engine and therefore lowers the engine's fuel efficiency. Furthermore, the weight of the associated plumbing and hardware to heat the rings is another disadvantage of such designs.

Accordingly, it is desirable to have polygonal turbine frame stiffening rails that carry substantially only tension stress and very low thermal stresses. It also desirable to have a turbine frame constructed of thin annular casings and radial struts yet which still provide suitable rigidity and structural integrity of the turbine frame for carrying both compression and tension loads through the struts without undesirable deflections of the hub which would affect the proper positioning of the rotor shaft supported thereby.

SUMMARY OF THE INVENTION

A turbine frame includes at least one and preferably two axially spaced apart polygonal stiffening rails, a forward rail and an aft rail, circumferentially disposed on an annular casing of the frame which has a plurality of circumferentially disposed generally radially extending struts mounted to the casing. The rails have at least one section with a constant cross-sectional area normal to the casing in a circumferential direction around the case, a linear centroid distribution of the cross-sections in the circumferential direction, and the centroids lie in a first plane P1 which is parallel to and spaced apart from a second plane P2 that is tangential to the casing mid-way between adjacent struts.

One embodiment provides for non-symmetrical rail first sections with left and right hand side linear centroid distributions that are not co-linear while another embodiment provides for symmetrical rail first sections with left and right hand side linear centroid distributions that are co-linear. Another embodiment provides for a rail second section that is integral with a boss surrounding a radially outer entrance to the strut disposed through the casing.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Description of the Preferred Embodiment(s)

Figure 1:
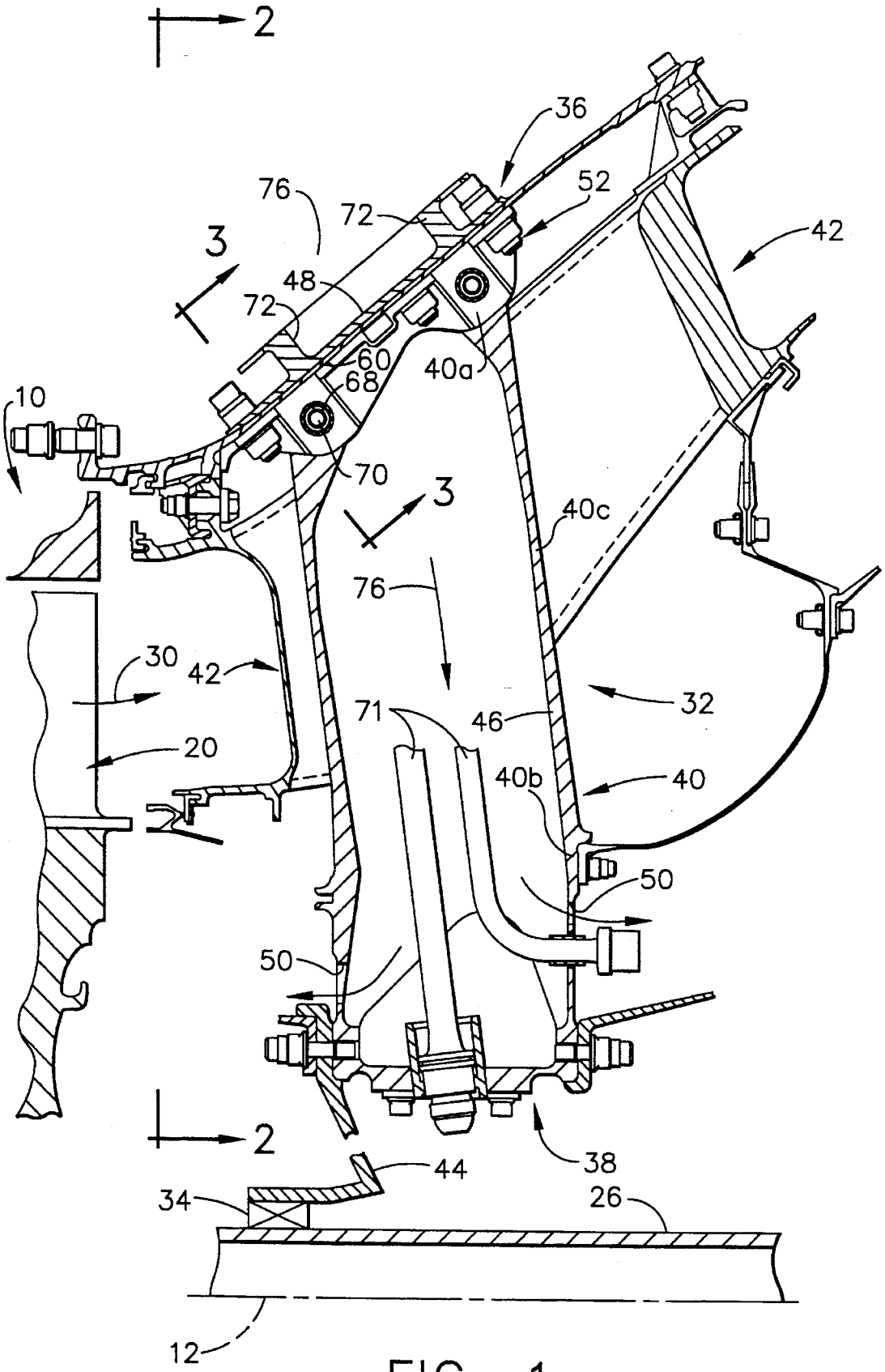
FIG. 1 is an axial, partly cross-sectional view of a portion of a gas turbine engine showing a turbine frame having polygonal stiffening rails in accordance with an exemplary embodiment of the present invention.

Illustrated schematically in FIG. 1 is a portion of an exemplary gas turbine engine 10 having an axial, or longitudinal centerline axis 12. Conventionally disposed about the centerline axis 12 in serial flow communication are a fan, compressor, and combustor (all not shown), high pressure turbine (HPT) 20, and low pressure turbine (LPT, also not shown), all of which are conventional. A first shaft (not shown) joins the compressor to the HPT 20, and a second shaft 26 joins the fan to the LPT. During operation, air enters the fan, a portion of which is compressed in the compressor for flow to the combustor wherein it is mixed with fuel and ignited for generating combustion gases 30 which flow downstream through the HPT 20 and the LPT which extract energy therefrom for rotating the first and second shafts.

An annular turbine frame 32 in accordance with one embodiment of the present invention is provided for supporting a conventional bearing 34 which, in turn, supports one end of the second shaft 26 for allowing rotation thereof. Alternatively, the frame 32 may support the aft end of the HPT shaft (not shown). The turbine frame 32 is disposed downstream of the HPT 20 and, therefore, must be protected from the combustion gases 30 which flow therethrough.

Figure 2:
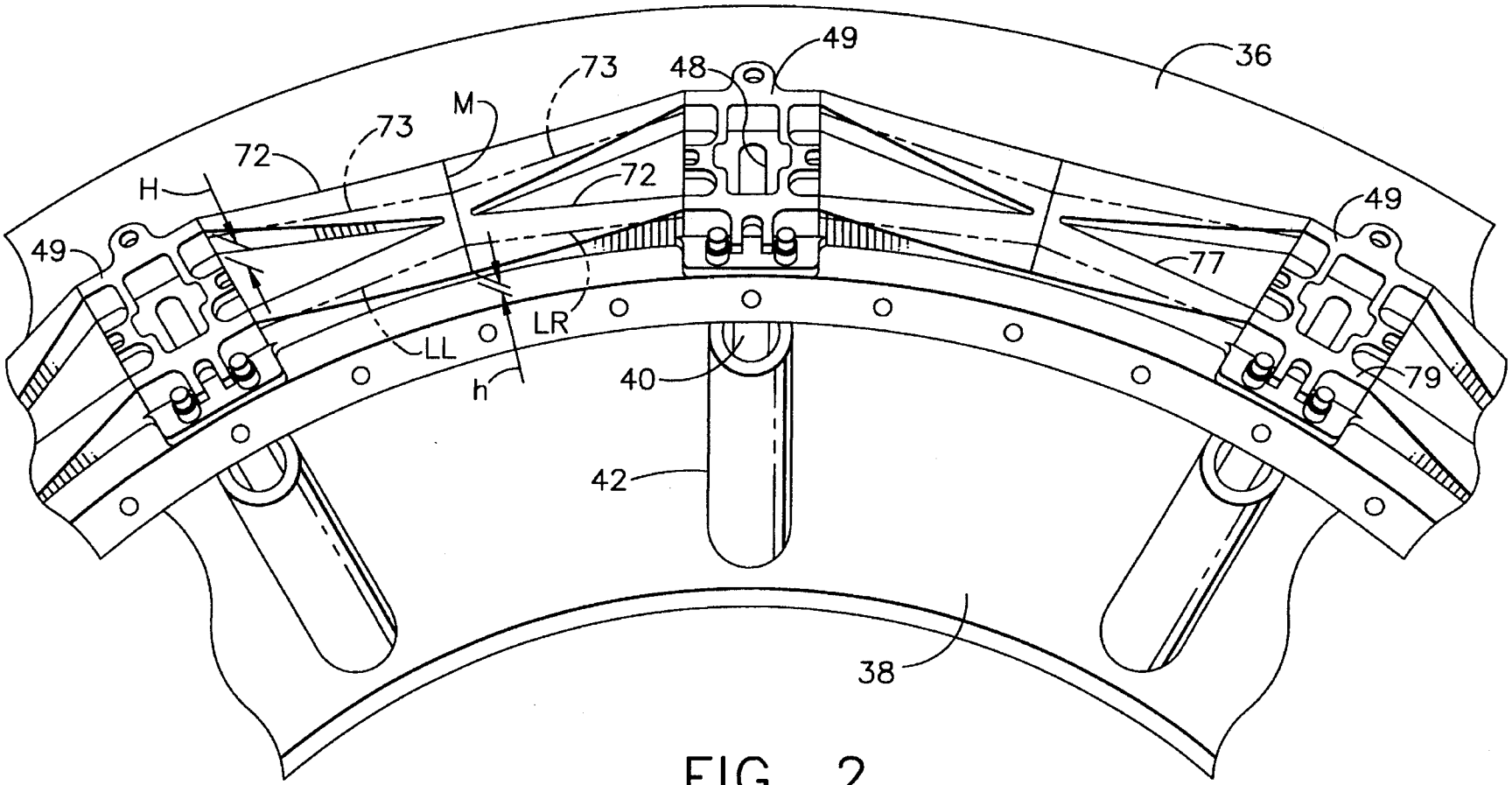
FIG. 2 is a transverse perspective view of the turbine frame illustrated in FIG. 1 taken along line 2—2.

The turbine frame 32 as illustrated in FIGS. 1 and 2 includes a first structural ring 36, or casing for example, disposed coaxially about the centerline axis 12. The frame 32 also includes a second structural ring 38, or hub for example, disposed coaxially with the first structural ring 36 about the centerline axis 12 and spaced radially inwardly therefrom. The term first structural ring and casing will be used interchangeably through out the patent because of the dual functionality of the casing, structural and gas flow containment, and the terms second structural ring and hub will be used interchangeably throughout the patent because of the dual functionality of the hub structural functionality with respect to the frame and support of the bearing. A plurality of circumferentially spaced apart hollow struts 40 extend radially between the first and second structural rings 36 and 38 and are fixedly joined thereto.

The frame 32 also includes a plurality of conventional fairings 42 each of which conventionally surrounds a respective one of the struts 40 for protecting the struts from the combustion gases 30 which flow through the turbine frame 32. Conventionally joined to the hub 38 is a conventional, generally conical sump member 44 which supports the bearing 34 in its central bore.

Each of the struts 40 includes a first, or outer, end **40*a* and a radially opposite second, or inner, end 40*b*, with an elongate center portion 40*c* extending therebetween. The strut 40 is hollow and includes a through channel 46 extending completely through the strut 40 from the outer end 40*a* and through the center portion 40*c* to the inner end 40*b*. The through channel 46 provides for passing cooling airflow 76 through for cooling engine structures as desired and/or for passage of conventional service lines 71 or pipes for carrying oil, for example, through the first ring 36, hub 38, and corresponding struts 40 for channeling oil to and from the region of the sump 44**.

Referring to FIG. 1, the casing 36 includes a plurality of circumferentially spaced apart first ports 48 extending radially therethrough, and the hub 38 similarly includes a plurality of circumferentially spaced apart second ports 50 extending radially therethrough. Disposed on the outside of casing 36 are bosses 49 surrounding the outer end 40*a* of the strut 40 to help attach pipes and other fittings (not shown) which help route the conventional service lines 71 and cooling air 76 through the casing and to the channel 46.

Figure 9:
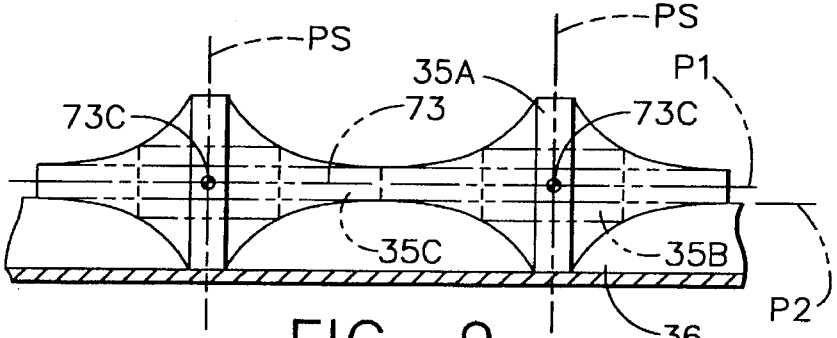
FIG. 9 is a cut-a-way perspective view through 4—4 of FIG. 3 with cross-sections of the rails illustrated in FIGS. 5 and 6 superimposed thereon in an arrangement for the alternative embodiment illustrated in FIG. 8 having a symmetrical rail.
Figure 10:
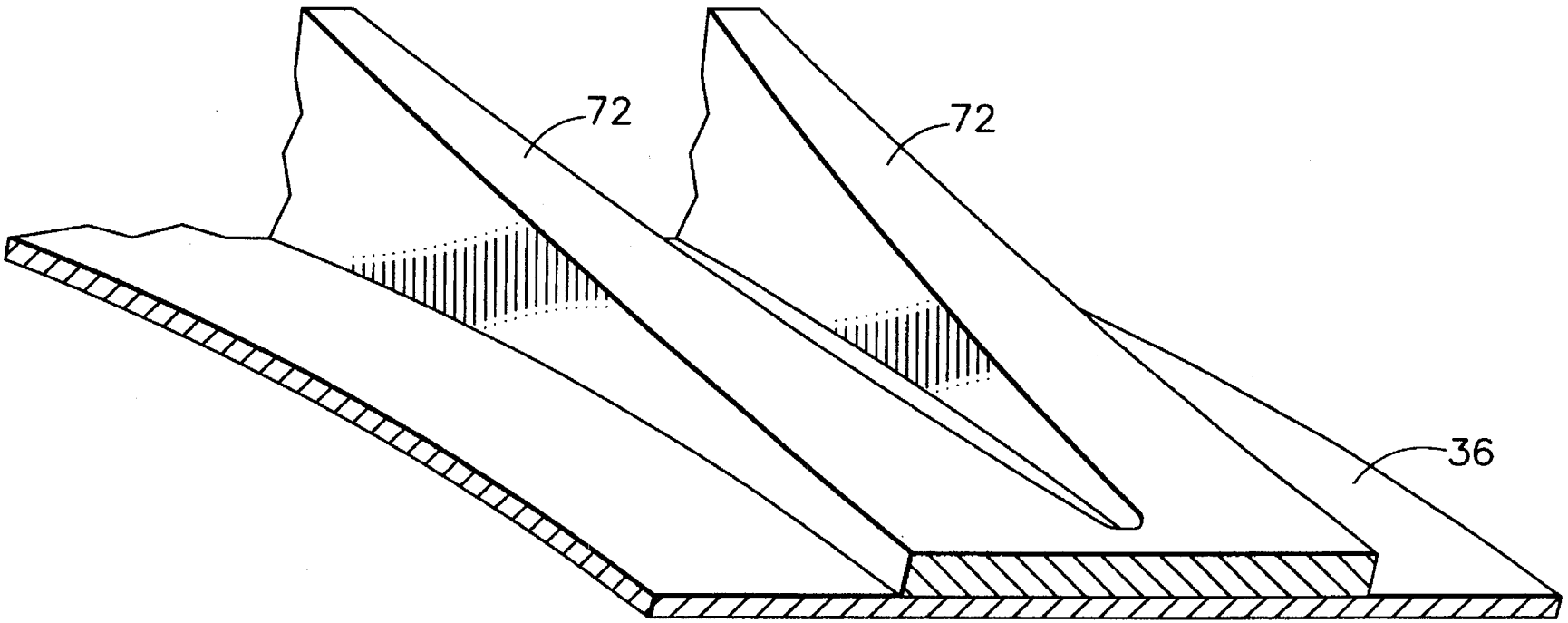
FIG. 10 is a cut-a-way perspective view of an alternative embodiment of the invention having a cylindrical casing.

In the exemplary embodiment illustrated in FIG. 1, the inner ends 40*b* of the struts 40 are integrally formed with the hub 38 in a common casting, for example, and the outer ends 40*a* of the struts 40 are removably fixedly joined to the casing 36 in accordance with the present invention. In alternate embodiments, the strut outer ends 40*a* may be integrally joined to the casing 36 in a common casting, for example, with the strut inner ends 40*b* being removably joined to the hub 38 also in accordance with the present invention. In either configuration, the turbine frame 32 further includes a plurality of clevises 52 which removably join the strut outer ends 40*a* to the casing 36 in the configuration illustrated in FIGS. 1 and 3, or removably join the inner ends 40*b* to the hub 38 (not shown). In either configuration, each of the clevises 52 is disposed between a respective one of the strut ends 40*a*, 40*b* and the respective ring, i.e. casing 36 or hub 38, in alignment with respective ones of the first or second ports 48, 50 for removably joining the struts 40 to the first or second ring, i.e. casing 36 or hub 38, for both carrying loads and providing access therethrough. The clevises 52 include first and second legs (not shown) which together with the strut outer end 40*a* have a pair of generally axially spaced apart line-drilled bores 68 extending therethrough which receive a respective pair of conventional expansion bolts 70 for removably fixedly joining the strut outer end 40*a* to the clevises 52. This allows the strut through channel 46 to be disposed generally axially between the two expansion bolts 70 and aligned with both the base aperture 60 and the first port 48. The casing 36 is made relatively thin and annular, either conical as shown or cylindrical as illustrated in FIG. 9. Additional structural support is required to maintain the structural integrity of the frame and casing including its size and shape. To that end the present invention provides at least one and preferably two axially spaced apart annular polygonal stiffening rails 72 disposed on the outside of the casing 36 on opposite, axial sides of the clevises 52 and the first ports 48 for carrying loads between the struts 40 and the casing 36 without interruption by the first ports 48, for example.

Referring more particularly to FIG. 2, the pair of axially spaced apart annular polygonal stiffening rails 72 are preferably machined integral with the casing 36. The respective stiffening rails 72 are continuous and uninterrupted annular members which carry loads in the hoop-stress direction without interruption by either the ports 48 or the struts 40 joined to the casing 36. In this way, loads may be transmitted from the hub 38 through the struts 40 and through the clevises 52 (in FIG. 1) to the casing 36, with the stiffening rails 72 ensuring substantially rigid annular members to which the struts 40 are connected.

Figure 3:
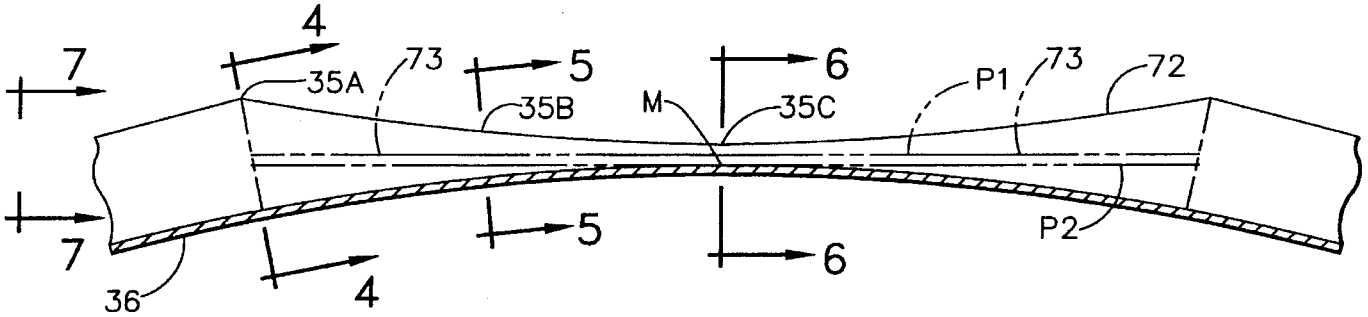
FIG. 3 is a cross-sectional axially facing view of one of the polygonal stiffening rails between adjacent struts illustrated in FIG. 2.
Figure 6:
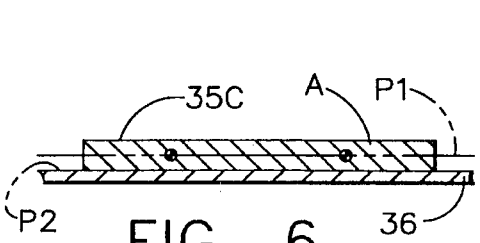
FIG. 6 is a is a cross-sectional circumferentially facing view at a first circumferential location taken through the polygonal stiffening rail along line 6—6 illustrated in FIG. 3.
Figure 5:
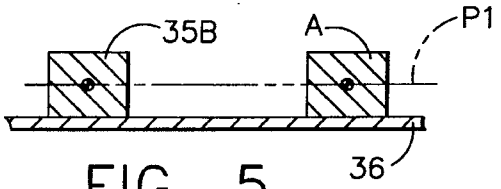
FIG. 5 is a is a cross-sectional circumferentially facing view at a first circumferential location taken through the polygonal stiffening rail along line 5—5 illustrated in FIG. 3.
Figure 7:
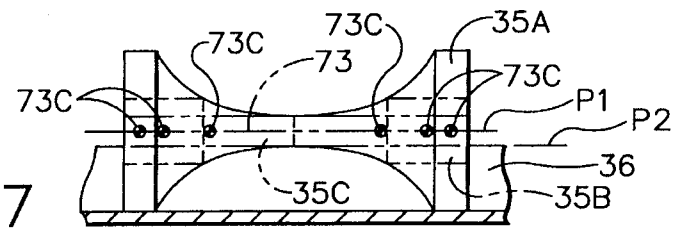
FIG. 7 is a cut-a-way perspective view through 4—4 of FIG. 3 with cross-sections of the rails illustrated in FIGS. 5 and 6 superimposed thereon in an arrangement for a non-symmetrical rail.
Figure 4:
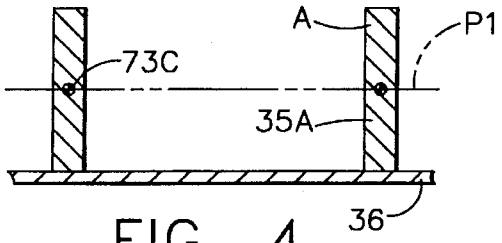
FIG. 4 is a is a circumferentially facing or radial cross-sectional view at a first circumferential location taken through the polygonal stiffening rail along line 4—4 illustrated in FIG. 3.

Referring more particularly to FIG. 3, each of the rails 72 has a plurality of first sections 77 between the struts 40 with a constant radial cross-sectional area A as illustrated by cross-sections 35A, 35B, and 35C in FIGS. 4, 5, and 6 respectively taken through the rails in planes indicated by 4—4, 5—5, and 6—6 that are normal to the casing 36 in a circumferential direction around the casing 36. The linear centroid distribution 73 of the cross-sections 35A–35C in the circumferential direction between the struts 40 is illustrated in FIGS. 4, 5, and 6 by centroids 73C taken together with FIG. 2. Further illustrated in FIG. 7 is the distribution 73 of the centroids 73C of the superimposed radial cross-sections 35A–35C in FIGS. 4–6. Essentially all of the centroids 73C lie in a flat first plane P1 that is generally parallel to a flat second plane P2 that is tangential to the casing 36 at a mid-line M on the casing mid-way between the struts 40 as seen in FIGS. 2 and 3–7.

Referring more particularly to FIG. 2, each of the rails 72 has constant cross-sectional area A and a maximum radial height H, as measured in a direction normal to the casing 36 and in a radially extending plane through the centerline axis 12 in FIG. 1, at the boss 49 and is sized to decrease to its minimum height h at substantially the mid-line M on the casing 36 between the circumferentially adjacent struts 40. This forms two lines of centroids 73C a left line LL and a right line LR which are linear but not co-linear and which lie in the first plane P1 (in FIGS. 3–7) which is parallel to and spaced apart from the second plane P2 (in FIGS. 3–7) that is tangential to the conical casing 36 at the mid-line M. The exemplary embodiment illustrated in FIG. 2 depicts a non-symmetrical first section 77 of the rail 72 between the struts. The first section 77 is continuously attached to a second section 79 that is integral with the flat top bosses 49 on the casing.

Figure 8:
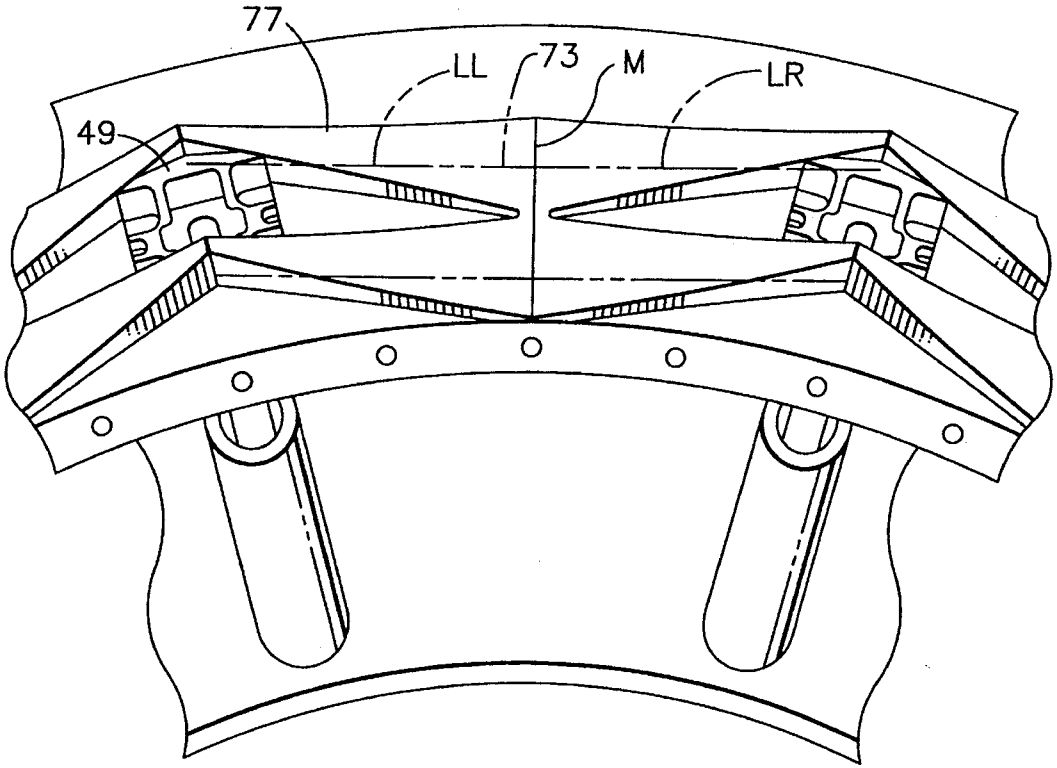
FIG. 8 is a transverse perspective view of the turbine frame illustrated in FIG. 1 taken along line 2—2 illustrating an alternative embodiment of the present invention having a symmetrical rail.

However if, for design purposes for example as illustrated in FIG. 8, the bosses 49 were not integral with the rails 72 then the rails could be constructed with only first sections 77 having the left line LL and the right line LR centroid distribution fully extending around the rails 72. Furthermore, if the first sections 77 are constructed symmetrically about a symmetry plane PS, as illustrated in FIG. 9, that is normal to the surface of the casing 36 and perpendicular to the centerline axis 12 in FIG. 1 then the left line LL and the right line LR centroid distribution would 73 be co-linear as shown in FIGS. 8 and 9. FIG. 9 illustrates, by superposition of the cross-sections in FIGS. 5 and 6, that the centroids 73C are linear and form a linear centroid distribution 73 which lies in the symmetry plane PS and in the first plane P1 that is generally parallel to the flat second plane P2 which is tangential to the casing 36 at the mid-line M on the casing mid-way between the struts 40 as seen in FIGS. 8.

The exemplary embodiment illustrated herein depicts a conical casing 36 for which the first plane P1 and the second plane P2 are not parallel to the engine centerline 12. If as illustrated in FIG. 9 the casing 36 were cylindrical, as contemplated by the present invention then the planes would be parallel to the engine center-line. The two axially spaced apart rails 72 may merge in the axial direction as shown in the exemplary embodiment illustrated herein. Furthermore casing 36 may effectively form a portion of the rails in the mid-point region and should be considered as such when designing the rails.

The constant cross-sectional area and the linear centroid distribution features allow the optimum use of material to stiffen the load path between the struts' radially outer ends by providing a linear load path in the circumferential direction between the struts which is therefore loaded in tension only from the radial punch loads exerted by the struts 40 when transmitting loads from the bearing 34. The shape of the polygonal stiffeners also reduces thermal stress, relative to prior art. The desire for a linear arrangement of the stiffening rail centroids requires that the rail be made closer to the casing in between struts, as opposed to at the strut ends, and becomes wider, expanding parallel to the casing skin, in order to maintain the constant area requirement.

Because the stiffening rail is not continuous at a set height above the casing skin the ability of thermal gradients to generate stress and lower fatigue life is greatly reduced. It may be necessary to vary somewhat from the exact arrangements, designs, and construction shown in the FIGS. and discussed above for various engineering considerations.

The geometry of the case, with the circular ID, lends itself to conventional machining (Turning, ECM) to form the geometry, such that forged raw material may be used. Such a design has advantages in material properties and tolerance control, as compared with a casting, and at acceptable cost. The design also lends itself to a cast design, particularly a centrifugal casting, for further cost advantage, in cases where cast material properties are acceptable.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts fixedly joined to and radially extending between said outer and inner structural rings;

at least one circumferentially extending stiffening rail, said rail being disposed around said outer structural ring and having a plurality of first sections between adjacent ones of said struts;

each of said first sections having a substantially constant radial cross-sectional area and a substantially linear distribution of cross-sectional centroids such that said centroids lie along at least one substantially straight line in a first plane which is parallel to and spaced apart from a second plane; and said second plane is substantially tangential to said outer structural ring mid-way between said adjacent struts.

2. A frame according to claim 1 further wherein said rail includes a plurality of second sections that are each integral with a boss surrounding a radially outer entrance to each of said struts.

3. A frame according to claim i wherein each of said first sections is symmetrical about a plane of symmetry that is normal to said outer structural ring and coextensive with said straight line.

4. A frame according to claim 2 wherein each of said first sections is symmetrical about a plane of symmetry that is normal to said outer structural ring and coextensive with said straight line.

5. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

at least one circumferentially extending stiffening rail, said rail being disposed on said outer structural ring and having a plurality of first sections between adjacent ones of said struts;

each of said first sections having a substantially constant radial cross-sectional area and a substantially linear distribution of cross-sectional centroids such that said centroids lie along at least one substantially straight line in a first plane which is parallel to and spaced apart from a second plane;

said second plane is substantially tangential to said outer structural ring mid-way between said adjacent struts, each of said first sections is non-symmetrical about any plane that is at a right angle to said centerline axis, said centroids lie along a first substantially straight line in a left hand side of said first section and along a second substantially straight line in a right hand side of said first section, and said first and second straight lines are not co-linear.

6. A frame according to claim 5 wherein said one circumferentially extending stiffening rail is a forward rail and the frame further comprises an aft rail wherein said forward and aft rails coincide near a mid-line along said outer structural ring mid-way between said adjacent struts;

said aft rail is disposed on said outer structural ring aft of said forward rail and has an aft plurality of first sections between adjacent ones of said struts; and each of said first sections in said aft plurality has a substantially constant radial cross-sectional area and a substantially linear distribution of cross-sectional centroids such that said centroids of said aft plurality lie along a third substantially straight line in a left hand side of said first section and along a fourth substantially straight line in a right hand side of said first section, said third and fourth substantially straight lines lie in a third plane which is parallel to and spaced apart from a fourth plane, said fourth plane is substantially tangential to said outer structural ring midway between said adjacent struts, each of said aft plurality of first sections is non-symmetrical about any plane that is at a right angle to said centerline axis, and said third and fourth straight lines are not co-linear.

7. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

at least one circumferentially extending stiffening rail, said rail being disposed on said outer structural ring and having a plurality of first sections between adjacent ones of said struts;

each of said first sections having a substantially constant radial cross-sectional area and a substantially linear distribution of cross-sectional centroids such that said centroids lie along at least one substantially straight line in a first plane which is parallel to and spaced apart from a second plane;

said second plane is substantially tangential to said outer structural ring mid-way between said adjacent struts;

each of said first sections is symmetrical about a plane of symmetry that is normal to said outer structural ring and coextensive with said straight line;

said one circumferentially extending stiffening rail is a forward rail and the frame further comprises an aft rail wherein said forward and aft rails coincide near a mid-line along said outer structural ring mid-way between said adjacent struts;

said aft rail is disposed on said outer structural ring aft of said forward rail and has an aft plurality of first sections between adjacent ones of said struts, and each of said first sections in said aft plurality has a substantially constant radial cross-sectional area and a substantially linear distribution of cross-sectional centroids such that said centroids of said aft plurality lie along one substantially straight line in said first plane.

8. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

at least one circumferentially extending stiffening rail, said rail being disposed on said outer structural ring and having a plurality of first sections between adjacent ones of said struts;

each of said first sections having a substantially constant radial cross-sectional area and a substantially linear distribution of cross-sectional centroids such that said centroids lie along at least one substantially straight line in a first plane which is parallel to and spaced apart from a second plane;

said second plane is substantially tangential to said outer structural ring mid-way between said adjacent struts, said rail includes a second section that is integral with a boss surrounding a radially outer entrance to said strut, each of said first sections is non-symmetrical, about any plane normal to said axis, said centroids lie along a first substantially straight line in a left hand side of said first section and along a second substantially straight line in a right hand side of said first section, and said first and second straight lines are not co-linear.

9. A frame according to claim 8 wherein said one circumferentially extending stiffening rail is a forward rail and the frame further comprises an aft rail wherein said forward and aft rails coincide near a mid-line along said outer structural ring mid-way between said adjacent struts;

said aft rail is disposed on said outer structural ring aft of said forward rail and has an aft plurality of first sections between adjacent ones of said struts; and each of said first sections in said aft plurality has a substantially constant radial cross-sectional area and a substantially linear distribution of cross-sectional centroids such that said centroids of said aft plurality lie along a third substantially straight line in a left hand side of said first section and along a fourth substantially straight line in a right hand. Side of said first section, said third and fourth substantially straight lines lie in a third plane which is parallel to and spaced apart from a fourth plane, said third plane is substantially tangential to said outer structural ring midway between said adjacent struts, each of said aft plurality of first sections is non-symmetrical about any plane that is at a right angle to said centerline axis, and said third and fourth straight lines are not co-linear.

10. A frame according to claim 9 wherein said frame is a turbine frame and said inner structural ring is a hub for supporting a rotor and said outer structural ring is an annular casing for containing pressurized hot turbine gas flow.

11. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

two circumferentially extending stiffening rails, a forward rail and an aft rail, wherein said forward and aft rails coincide near a mid-line along said outer structural ring mid-way between said adjacent struts;

said aft rail is disposed on said outer structural ring aft of said forward rail and has an aft plurality of first sections between adjacent ones of said struts, and each of said first sections in said aft plurality has a substantially constant radial cross-sectional area and a substantially linear distribution of cross-sectional centroids such that said centroids of said aft plurality lie along one substantially straight line in a first plane which is parallel to an spaced apart from a second plane; and said second plane is substantially tangential to said outer structural ring mid-way between said adjacent struts.

12. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts fixedly joined to and radially extending between said outer and inner structural rings;

at least one circumferentially extending stiffening rail, said rail being disposed around said outer structural ring and having a plurality of first sections between adjacent ones of said struts;

each of said first sections having a substantially constant radial cross-sectional area and a substantially linear distribution of cross-sectional centroids such that said centroids lie along at least one substantially straight line in a first plane parallel to and spaced apart from a second plane; and each of said first sections having a mid-line along said outer structural ring mid-way between said adjacent struts, a substantially constant radial cross-sectional area, a minimum height and a maximum width at said mid-line, and a minimum width and a maximum height at said struts.

13. A frame according to claim 12 wherein each of said first sections is symmetrical about a plane of symmetry that is normal to said outer structural ring and coextensive with said substantially straight line.

14. A frame according to claim 12 further wherein said rail includes a plurality of second section that are each integral with a boss surrounding a radially outer entrance to each of said struts.

15. A frame according to claim 14 wherein each of said first sections is symmetrical about a plane of symmetry that is normal to said outer structural ring and coextensive with said straight line.

16. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts Joined radially between said outer and inner structural rings;

at least one circumferentially extending stiffening rail, said rail being disposed on said outer structural ring and having a plurality of first sections between adjacent ones of said struts;

each of said first sections having a mid-line along said outer structural ring mid-way between said adjacent struts, a substantially constant radial cross-sectional area, a minimum height and a maximum width at said mid-line, and a minimum width and a maximum height at said struts;

wherein each of said first sections is non-symmetrical about any plane that is at a right angle to said centerline axis, a first plurality of cross-sectional centroids lie along a first straight line in a left hand side of said first section and a second plurality of cross-sectional centroids lie along a second straight line in a right hand side of said first section, and said first and second straight lines are not co-linear.

17. A frame according to claim 16 wherein said one circumferentially extending stiffening rail is a forward rail and the frame further comprises an aft rail wherein said forward and aft rails coincide near said mid-line along said outer structural ring mid-way between said adjacent struts;

said aft rail is disposed on said outer structural ring aft of said forward rail and has an aft plurality of first sections between adjacent ones of said struts; and each of said first sections in said aft plurality has a substantially constant radial cross-sectional area and a substantially linear distribution of cross-sectional centroids such that said centroids of said aft plurality lie along a third substantially straight line in a left hand side of said first section along a fourth substantially straight line in a right hand side of said first section, said third and fourth substantially straight lines lie in a third plane which is parrallel to and spaced apart from a fourth plane, said fourth plane is substantially tangential to said outer structural ring mid-way between said adjacent struts, each of said aft plurality of first sections is non-symmetrical about any plane that is at a right angle to said centerline axis, and said third and fourth straight lines are not co-linear.

18. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

two circumferentially extending stiffening rails, comprising a forward rail and an aft rail said rails being disposed on said outer structural ring and having a plurality of first sections between adjacent ones of said struts;

wherein said two circumferentially extending stiffening rails coincide near said mid-line along said outer structural ring mid-way between said adjacent struts; and said aft rail has an aft plurality of first sections between adjacent ones of said struts wherein each of said first sections in said aft plurality has a substantially constant radial cross-sectional area and a substantially linear distribution of cross-sectional centroids such that said centroids of said aft plurality lie along one substantially straight line.

19. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

at least one circumferentially extending stiffening rail, said rail being disposed on said outer structural ring and having a plurality of first section between adjacent ones of said struts;

each of said first sections having a mid-line along said outer structural ring mid-way between said adjacent struts, a substantially constant radial cross-sectional area, a minimum height and a maximum width at said mid-line, and a minimum width and a maximum height at said struts;

said rail includes a plurality of second section that are each integral with a boss surrounding a radially outer entrance to each of said struts; and wherein each of said first sections is non-symmetrical, about any plane normal to said axis a first plurality of cross-sectional centroids lie along a first straight line in a left hand side of said first section and a second plurality of cross-sectional centroids lie along a second straight line in a right hand side of said first section, and said first and second straight lines are not co-linear.

20. A frame according to claim 19 wherein said one circumferentially extending stiffening rail is a forward rail and the frame further comprises an aft rail wherein said forward and aft rails coincide near said mid-line along said outer structural ring mid-way between said adjacent struts;

said aft rail is disposed on said outer structural ring aft of said forward rail and has an aft plurality of first sections between adjacent ones of said struts, each of said first sections in said aft plurality has a substantially constant radial cross-sectional area and a substantially linear distribution of cross-sectional centroids such that said centroids of said aft plurality lie along a third substantially straight line in a left hand side of said first section and along a fourth substantially straight lane in a right hand side of said first section, said third and fourth substantially straight lines lie in a third plane which is parallel to and spaced apart from a fourth plane, said fourth plane is substantially tangential to said outer structural ring mid-way between said adjacent struts, each of said aft plurality of first sections is non-symmetrical about any plane that is at a right angle to said centerline axis, and said third and fourth straight lines are not co-linear.

21. A frame according to claim 20 wherein said frame is a turbine frame and said inner structural ring is a hub for supporting a rotor and said outer structural ring is an annular casing for containing pressurized hot turbine gas flow.

22. A turbine frame according to claim 21 wherein said casing is conical.

23. A turbine frame according to claim 21 wherein said casing is cylindrical.

24. A gas turbine engine frame comprising:

an outer structural ring disposed coaxially about an axial centerline axis;

an inner structural ring disposed coaxially with said outer structural ring and spaced radially inward therefrom;

a plurality of circumferentially spaced apart struts joined radially between said outer and inner structural rings;

at least two circumferentially extending stiffening rails, said rails being disposed on said outer structural ring and each of said rails has a plurality of first sections between adjacent ones of said struts;

each of said first sections having a mid-line along said outer structural ring mid-way between said adjacent struts, a substantially constant radial cross-sectional area, a minimum height and a maximum width at said mid-line, and a minimum width and a maximum height at said struts;

said rails include a plurality of second section that are each integral with a boss surrounding a radially outer entrance to each of said struts;

wherein said rails are a forward rail and an aft rail wherein said forward and aft rails coincide near said mid-line along said outer structural ring mid-way between said adjacent struts;

said aft rail is disposed on said outer structural ring aft of said forward rail and has an aft plurality of said first sections between adjacent ones of said struts; and each of said first sections in said aft plurality has a substantially constant radial cross-sectional area and a substantially linear distribution of cross-sectional centroids such that said centroids of said aft plurality lie along one substantially straight line.

* * * * *